US005493945A

United States Patent [19]

Matsumura

[11] Patent Number: 5,493,945

[45] Date of Patent: Feb. 27, 1996

[54] APPARATUS FOR DRIVING PISTON BY FLUID PRESSURE

[75] Inventor: Toyokazu Matsumura, Kobe, Japan

[73] Assignee: Kabushiki Kaisha Kosmek, Japan

[21] Appl. No.: 382,172

[22] Filed: Feb. 1, 1995

[30] Foreign Application Priority Data

Feb. 1, 1994 [JP] Japan ..... 6-010434

[51] Int. Cl.[6] ..... F01L 25/02

[52] U.S. Cl. ..... 91/309; 91/304

[58] Field of Search ..... 91/304, 309, 313

[56] References Cited

U.S. PATENT DOCUMENTS 4,042,311 8/1977 Yonezawa .
4,050,356 9/1977 Jaggi et al. ..... 91/313
4,812,109 3/1989 Yonezawa .
5,050,482 9/1991 Yonezawa .
5,252,042 10/1993 Yonezawa .

*Primary Examiner*—F. Daniel Lopez
*Attorney, Agent, or Firm*—Bacon & Thomas

[57] ABSTRACT

A supply-discharge valve member (30) inserted into a valve casing (29) can be pushed downward by pressure fluid of an actuation chamber (35). A restriction passage (G) is constituted by a fitting clearance between a valve bore (61) and an opening-closing valve member (62) provided in the valve casing (29). The pressure fluid supplied to the chamber (35) is quickly discharged to an atmosphere side through the restriction passage (G) when an amount of the supplied fluid is extremely a little. When the supplied amount increases, since a flowing resistance of the restriction passage (G) increases and the pressure within the chamber (35) is increased, a closing valve surface (69) of the opening-closing valve member (62) is brought into contact with a valve seat (70) for closing by that pressure to prevent the pressure fluid from being discharged.

6 Claims, 5 Drawing Sheets

APPARATUS FOR DRIVING PISTON BY FLUID PRESSURE

BACKGROUND OF THE INVENTION

1. Field of the Invention

The present invention relates to an apparatus for driving a piston by fluid pressure such as pneumatic pressure or hydraulic pressure.

2. Description of Prior Art

Conventionally, as an apparatus for driving a piston by fluid pressure which is a subject for the present invention there has been known the one disclosed in U.S. Pat. No. 5,050,482. This is the apparatus previously proposed by the assignee of the present invention and its basic constitution is as follows.

As illustrated in a system view of FIG. 5, a piston 8 is vertically movably inserted into a cylinder 7. A driving chamber 9 is arranged between an upper wall 7*a* of the cylinder 7 and the piston 8. Pressure fluid is supplied to and discharged from the driving chamber 9 by a supply-discharge valve 13. The supply-discharge valve 13 is adapted to be switched between a supply position X of the pressure fluid and a discharge position Y thereof by a pilot valve 18. The symbol 14 designates a pressure supply port of the pressure fluid and the symbol 15 does a pressure discharge port thereof.

The basic constitution will be explained in detail with reference to FIG. 6 illustrating the apparatus disclosed in the above-mentioned prior art publication hereinafter.

The supply-discharge valve 13 comprises a cylindrical supply-discharge valve casing 29 disposed above the cylinder 7 and a supply-discharge valve member 30 vertically movably inserted into the supply-discharge valve casing 29. A supply actuation chamber 33 communicated with the pressure supply port 14 is arranged below the supply-discharge valve member 30 and a discharge actuation chamber 35 to be selectively communicated with the pressure supply port 14 and a pressure relief port 55 is arranged above the supply-discharge valve member 30.

The pilot valve 18 comprises a sleeve 44 inserted into a bore 30*d* of the supply-discharge valve member 30, a spool valve member 46 vertically movably inserted into the sleeve 44, an annular sealing member 48 arranged between the pressure supply port 14 and the discharge actuation chamber 35 and a pressure relief valve member 57 arranged between the discharge actuation chamber 35 and the pressure relief port 55. The annular sealing member 48 is fitted between an outer peripheral surface of the spool valve member 46 and a lower portion of the bore 30*d* so as to be brought into contact with a lower portion of the sleeve 44 from below. Further, the lower portion of the spool valve member 46 is fixedly secured to the piston 8.

As shown in FIGS. 5 and 6, the apparatus 2 for driving the piston by the fluid pressure having the basic constitution operates as follows.

When a pressure fluid supply valve 16 is opened, a pressure fluid such as a pressure air or a pressure oil is supplied from a fluid pressure source 17 to operate the driving apparatus 2. When the valve 16 is closed, the pressure fluid supply is stopped and then the operation of the driving apparatus 2 is stopped.

As shown in the left half view of FIG. 6, while the operation is stopped, the piston 8 and the spool valve member 46 are pushed back to the top dead center by a return spring 11, so that the supply-discharge valve member 30 is pushed up to the supply position X.

While the operation is continued, a descending drive stroke illustrated in the left half view thereof and an ascending return stroke illustrated in the right half view thereof are repeated.

During the descending drive stroke, since the pressure relief valve member 57 is opened and the pressure fluid within the discharge actuation chamber 35 is released from the pressure relief port 55 to the pressure discharge port 15, the supply-discharge valve member 30 is pushed up by the fluid pressure of the supply actuation chamber 33 to the supply position X on the upper side and the pressure fluid always supplied to the supply actuation chamber 33 is forced into a driving chamber 9 from a working chamber 32 to descend the piston 8.

During the ascending return stroke, when the piston 8 is near the bottom dead center, as shown in the right half view thereof, the annular sealing member 48 is opened and the pressure fluid always supplied from the pressure supply port 14 is introduced into the discharge actuation chamber 35 through the sleeve 44, so that the supply-discharge valve member 30 is pushed down by the fluid pressure to the discharge position Y on the lower side and the pressure fluid within the driving chamber 9 is released from the working chamber 32 to the pressure discharge port 15 through a discharge chamber 34 to ascend and return the piston 8 by the return spring 11. Thus, when the piston 8 reaches the top dead center, as shown in the left half view thereof, the pressure relief valve member 57 is opened, switching over to the descending drive stroke.

In the basic constitution, conventionally the pilot valve 18 is further constituted as follows.

As shown in FIG. 6, a cylinder bore 91 to be communicated with the discharge actuation chamber 35 is formed vertically in an upper portion of the supply-discharge valve casing 29, a piston 92 formed in an upper portion of the sleeve 44 is airtightly inserted into the cylinder bore 91 through an O-ring 93, a pressure receiving chamber 94 is formed below the piston 92, and a return spring 95 for urging the sleeve 44 downward is provided.

As noted above, the prior art has such an advantage that the driving apparatus 2 can be prevented from stopping at an extremely low speed.

That is, as shown in FIG. 5, while a hydraulic pump 3 of the plunger type is driven by the driving apparatus 2 to continue the pressure fluid supply even after completion of an extension of a hydraulic cylinder 86, when an extremely small amount of pressure oil leaks from a hydraulic actuation chamber 87, a switching valve 88 or the like or an extremely small amount of pressure oil enters a seal clearance of a sealing member, the piston 8 drives a plunger 22 of the hydraulic pump 3 at an extremely slow speed to supplement that extremely small amount of pressure oil.

When the piston 8 is driven at the extremely slow speed in this way to access the bottom dead center and the spool valve member 46 passes by the annular sealing member 48 at the extremely slow speed to separate therefrom a small distance, the pressure fluid within the pressure supply port 14 flows into the discharge actuation chamber 35 to slowly push down the supply-discharge valve member 30 by a force corresponding to a pressure imposed onto a discharge pressure receiving surface 30*c*. On a midway of that slow pushing down, since the working chamber 32 is communicated with both the supply actuation chamber 33 and the discharge chamber 34, the pressure fluid within the driving chamber 9 is released from the working chamber 32 to the pressure discharge port 15.

Therefore, provided that a descending speed of the supply-discharge valve member 30 is extremely slow, the piston 8 is pushed up by a resilient force of the return spring 11 before completion of its descending stroke and the spool valve member 46 closes the sealing member 48 again on a midway of opening. Thereupon, a low pressure fluid is enclosed within the discharge actuation chamber 35 as well as the pressure fluid within the supply actuation chamber 33 is discharged from the working chamber 32 to the discharge chamber 34 along a shortcircuit. As a result, the supply-discharge valve member 30 stops on a midway of descending due to a balance between a pushing-down force applied from the discharge actuation chamber 35 and a pushing-up force applied from the supply actuation chamber 33, so that it becomes impossible to drive the piston 8 downward and the driving apparatus 2 is stopped.

But, according to the above-mentioned prior art, when the spool valve member 46 is descended at the extremely slow speed and its outer peripheral surface separates from an inner peripheral surface of the annular sealing member 48 at the extremely slow speed, the pressure fluid within the pressure supply port 14 is introduced into the sleeve 44 through a valve opening clearance between the spool valve member 46 and the sealing member 48 to gradually increase a pressure within the pressure receiving chamber 94 at the extremely slow speed. Thereupon, when the pressure within the pressure receiving chamber 94 reaches a predetermined pressure, as indicated by a solid line in the right half view, since the sleeve 44 is ascended by that internal pressure against two springs 58, 95 so that also the sealing member 48 is pushed up accompanying therewith, the sealing member 48 is quickly separated from the spool valve member 46.

Thereupon, the pressure fluid within the pressure supply port 14 is introduced into the discharge actuation chamber 35 through the large valve opening clearance to quickly increase the pressure within the discharge actuation chamber 35, to strongly push down and quickly descend the supply-discharge valve member 30 by the increased pressure and to switch the supply-discharge valve member 30 to the discharge position Y in the right half view. Since the supply-discharge valve member 30 is strongly pushed down and quickly descended in that way, its midway stop during descending can be prevented. As a result, it is possible to prevent the driving apparatus 2 from falling into an abnormal stop.

In this way, the prior art has such an advantage that the driving apparatus 2 can be prevented from stopping even when being driven at the extremely slow speed. But, there still remains a problem to be improved as follows.

That is, since the annular sealing member 48 has its inner peripheral surface adapted to come into slidable contact with an outer peripheral surface of the spool valve member 46 and its outer peripheral surface adapted to come into slidable contact with the bore 30*d*, wearing-out is increased as a total operation time of the driving apparatus 2 becomes longer, so that the sealing performance degrades.

While the piston 8 is stopped at a midway height by an increase of pressure within a pump chamber 21 during the descending drive of the piston 8, when the pressure fluid within the pressure supply port 14 leaks into the sleeve 44 due to the degradation of the sealing performance of the sealing member 48, the leaked pressure fluid increases the pressure within the discharge actuation chamber 35 at the extremely slow speed, so that the supply-discharge valve member 30 is descended at the extremely slow speed by that increased pressure. Therefore, due to the same reason as that described above, the supply-discharge valve member 30 stops at a midway descend position, so that the driving apparatus 2 falls into the abnormal stop.

SUMMARY OF THE INVENTION

It is an object of the present invention to reliably prevent an abnormal stopping of a driving apparatus.

For accomplishing the above object, the present invention is characterized in that the driving apparatus is constituted as follows, for example as shown in FIGS. 1 through 3.

The first invention is constituted as follows,

There is provided a fluid pressure supply-discharge valve 13 for supplying and discharging a pressure fluid to and from a driving chamber 9 facing a piston 8. A supply-discharge valve member 30 is so accommodated within a supply-discharge valve casing 29 of the supply-discharge valve 13 as to be switchably movable. A supply actuation chamber 33 for switching the supply-discharge valve member 30 to a supply position X and a discharge actuation chamber 35 for switching the valve member 30 to a discharge position Y are arranged on opposite end sides of the valve member 30, and a pilot valve 18 for supplying and discharging the pressure fluid to and from the discharge actuation chamber 35 is provided. Between the discharge actuation chamber 35 and an outside space of the supply-discharge valve casing 29 there are interposed an opening-closing means 60 to be held in an opened state when the pressure within the discharge actuation chamber 35 is lower than a predetermined pressure and to cancel the opened state when the pressure within the discharge actuation chamber 35 becomes at least the predetermined pressure. A restriction passage G is arranged in tandem or series relative to an opening and closing portion 69, 70 of the opening-closing means 60.

The second invention is obtained by applying the following improvements to the driving apparatus having the above basic constitution and is constituted as follows, The discharge actuation chamber 35 is communicated with a space outside the supply-discharge valve casing 29 through the restriction passage G and an opening-closing portion 69, 70 of the opening-closing means 60 in order. The opening-closing means 60 comprises a valve bore 61 communion ted with the discharge actuation chamber 35, an opening-closing valve member 62 vertically slidably inserted into the valve bore 61, the opening-closing portion 69, 70 comprising a closing valve surface 69 formed in an upper portion of the opening-closing valve member 62 and a valve seat 70 formed in an upper end wall 65 of the valve bore 61, a valve opening spring 71 for separating the opening-closing valve member 62 from the valve seat 70. The restriction passage G is constituted by a fitting clearance between an inner peripheral surface of the valve bore 61 and an outer peripheral surface of the opening-closing valve member 62.

The first invention functions as follows, for example as shown in FIGS. 1 through 3.

Since the pressure fluid of the discharge actuation chamber 35 has been already discharged over a duration from an initial stage to an middle stage of the descending stroke of the piston 8, the supply-discharge valve member 30 is held at the supply position X and the opening-closing portions 69, 70 of the opening-closing means 60 are opened.

When the piston 8 is driven toward the bottom dead center at the extremely slow speed at the end stage of the descending stroke, a valve opening clearance (herein, a clearance between a pressure supply passage 53 formed in the spool valve member 46 and an annular sealing member 48) for the pressure supply of the pilot valve 18 starts to open a little. Since the valve opening clearance is very small, though an extremely small amount of the pressure fluid is supplied to the discharge actuation chamber 35, the extremely small amount of the pressure fluid is quickly discharged to an atmosphere side through a restriction passage G (refer to an arrow in FIG. 1). Therefore, the pressure within the discharge actuation chamber 35 is prevented from increasing more than the predetermined pressure, so that the supply-discharge valve member 30 is held at the supply position X.

When the piston 8 is further driven toward the bottom dead center and the valve opening clearance of the pilot valve 18 becomes larger so that a large amount of the pressure fluid starts to be supplied to the discharge actuation chamber 35, since a flowing resistance of the restriction passage G increases, the pressure of the discharge actuation chamber 35 increases correspondingly. When the pressure becomes larger than the predetermined pressure, since the opening-closing portions 69, 70 are closed to prevent the discharging of the pressure fluid, the pressure within the discharge actuation chamber 35 is quickly increased and the supply-discharge valve member 30 is pushed strongly by the increased pressure to the discharge position Y (refer to the right half view in FIG. 3).

Further, while the piston 8 stops at a midway height position between the top dead center and the bottom dead center, also when the pressure fluid leaks extremely a little from a sealing portion (herein, the annular sealing member 48) of the pilot valve 18 to the discharge actuation chamber 35, similarly to the aforementioned case, the extremely small amount of the pressure fluid is quickly discharged to the atmosphere side through the restriction passage G. Therefore, the supply-discharge valve member 30 is held at the supply position X.

Then, when the piston 8 is driven toward the bottom dead center, similarly to the aforementioned case of the extremely slow driving, the opening-closing portions 69, 70 are closed when the pressure of the discharge actuation chamber 35 becomes at least the predetermined pressure to prevent the discharge of the pressure fluid, so that the supply-discharge valve member 30 is pushed strongly from the supply position X to the discharge position Y.

As noted above, in either case, since the supply-discharge valve member 30 can be pushed strongly from the supply position X to the discharge position Y when the pressure of the discharge actuation chamber 35 increases sufficiently, the supply-discharge valve member 30 is prevented from being stopped during its switching.

The second invention functions as follows.

Since the pressure fluid of the discharge actuation chamber 35 has been already discharged over a duration from an initial stage to an middle stage of the descending stroke of the piston 8, the supply-discharge valve member 30 is held at the supply position X and the opening-closing valve member 62 is pushed downward by a valve opening spring 71 so that a closing valve surface 69 is separated from a valve seat 70.

When the spool valve member 46 of the pilot valve 18 is driven toward the bottom dead center at the extremely slow speed, as indicated by the alternate long and two short dashes line in FIG. 1, a clearance between the pressure supply passage 53 and the annular sealing member 48 starts to open a little. Since the valve opening clearance is very small, though an extremely small amount of the pressure fluid is supplied from the supply port 14 to the discharge actuation chamber 35, the extremely small amount of the pressure fluid is quickly discharged to the atmosphere side through the restriction passage G (refer to an arrow in FIG. 1). Therefore, the pressure within the discharge actuation chamber 35 is prevented from increasing more than the predetermined pressure and the supply-discharge valve member 30 is held at the supply position X.

When the spool valve member 46 is further descended to enlarge the valve opening clearance, a large amount of the pressure fluid starts to be supplied from the supply port 14 to the discharge actuation chamber 35, so that the flowing resistance of the restriction passage G increases. Thereupon, the pressure of the discharge actuation chamber 35 increases. When the pressure becomes at least the predetermined pressure, the opening-closing valve member 62 is moved upward by a vertical differential pressure so that the closing valve surface 69 is brought into closing contact with the valve seat 70. Thereby, since the discharging of the pressure fluid is prevented, the pressure within the discharge actuation chamber 35 is quickly increased, so that the supply-discharge valve member 30 is pushed strongly to the discharge position Y (refer to the right half view in FIG. 3) by the increased pressure.

Further, while the spool valve member 46 slops at a midway position during its descending, even when the pressure fluid leaks extremely a little from the annular sealing member 48 to the discharge actuation chamber 35, similarly to the above-mentioned case, the extremely small amount of the pressure fluid is discharged quickly to the atmosphere side through the restriction passage G, so that the supply-discharge valve member 30 is held at the supply position X.

Then, when the spool valve member 46 is driven toward the bottom dead center, similarly to the case of the above-mentioned very slow driving, the opening-closing portion 69, 70 is closed to prevent the discharging of the pressure fluid when the pressure of the discharge actuation chamber 35 has become at least the predetermined pressure, so that the supply-discharge valve member 30 is pushed strongly from the supply position X to the discharge position Y.

As noted above, in either case, since the supply-discharge valve member 30 can be pushed strongly from the supply position X to the discharge position Y when the pressure of the discharge actuation chamber 35 increases sufficiently, the supply-discharge valve member 30 is prevented from being stopped during its switching.

Since the respective inventions of claims 1 and 4 have the above-mentioned constitutions and functions, the following advantages can be obtained.

When the extremely small amount of the pressure fluid is supplied to the discharge actuation chamber at the time of commencement of the pressure fluid supply by the pilot valve or by the leak and the like from the sealing portion of the pilot valve, the pressure increase of the discharge actuation chamber can be prevented by discharging the supplied pressure fluid from the restriction passage as well as the pressure within the discharge actuation chamber can be increased quickly by an effect of the restriction passage at the time of increase of the supply amount of the pressure fluid.

Accordingly, it is possible to strongly push the supply-discharge valve member from the supply position to the discharge position and the supply-discharge valve member can be prevented from stopping during its switching. As a result, the operation of the driving apparatus can be continued.

By the way, when the restriction passage is arranged between an inlet chamber of the opening-closing means and an outlet chamber thereof and the opening-closing valve member is so constituted as to be moved for valve closing by a differential pressure between both those chambers, the opening-closing means becomes simple in constitution and reliable in operation.

When the restriction passage is constituted by a fitting clearance between the valve bore and the opening-closing valve member provided in the opening-closing means, since it becomes possible to finish surface roughness and the like of the restriction passage with high accuracy, it becomes easy to set a flowing resistance of the restriction passage to a desired value and an operational accuracy of the opening-closing means enhances.

When the valve bore and the bore of the supply-discharge valve member are formed coaxially and the opening and closing valve member is fixedly secured to an upper portion of the sleeve inserted into the bore, the number of component members becomes less and the constitution becomes much simpler.

Further, when a pressure supply passage is formed in an upper portion of the spool valve member and a tubular saddle member is externally fitted around the outer peripheral surface of the spool valve member, durability of the annular sealing member improves greatly.

BRIEF DESCRIPTION OF THE DRAWINGS

FIG. 1 is an enlarged detailed view of FIG. 2 and a partial view of a supply-discharge valve of an apparatus for driving a piston by fluid pressure;

FIG. 2 is a vertical sectional view of a booster pump apparatus provided in the driving apparatus;

FIG. 3 is a schema tic view for explaining an operation of the driving apparatus;

FIG. 4 is a partial view showing a variant example of an opening-closing means disposed in the supply-discharge valve;

DETAILED DESCRIPTION OF THE PREFERRED EMBODIMENTS

Figure 1:
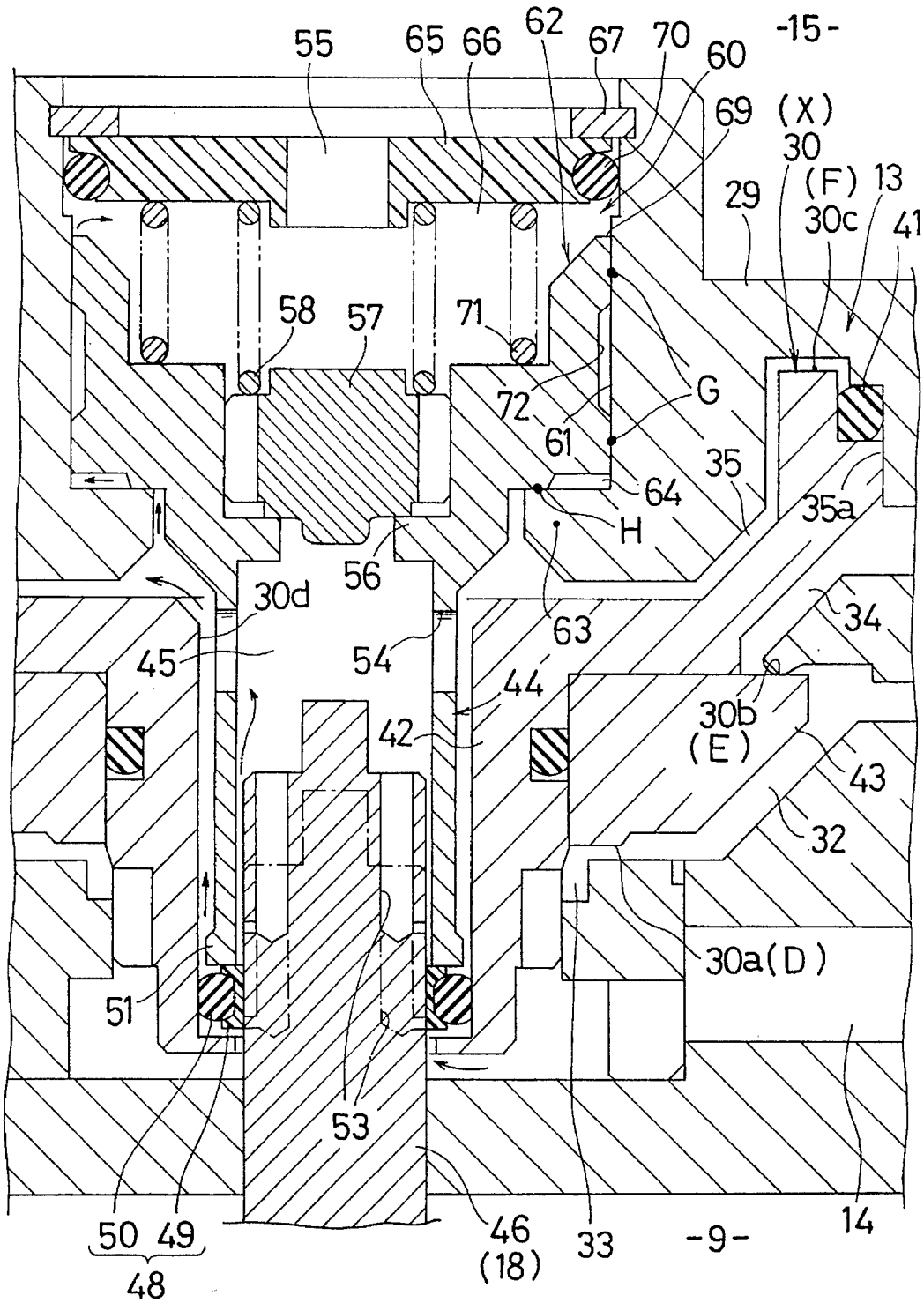
FIGS. 1 through 4 show one embodiment of the present invention.
Figure 2:
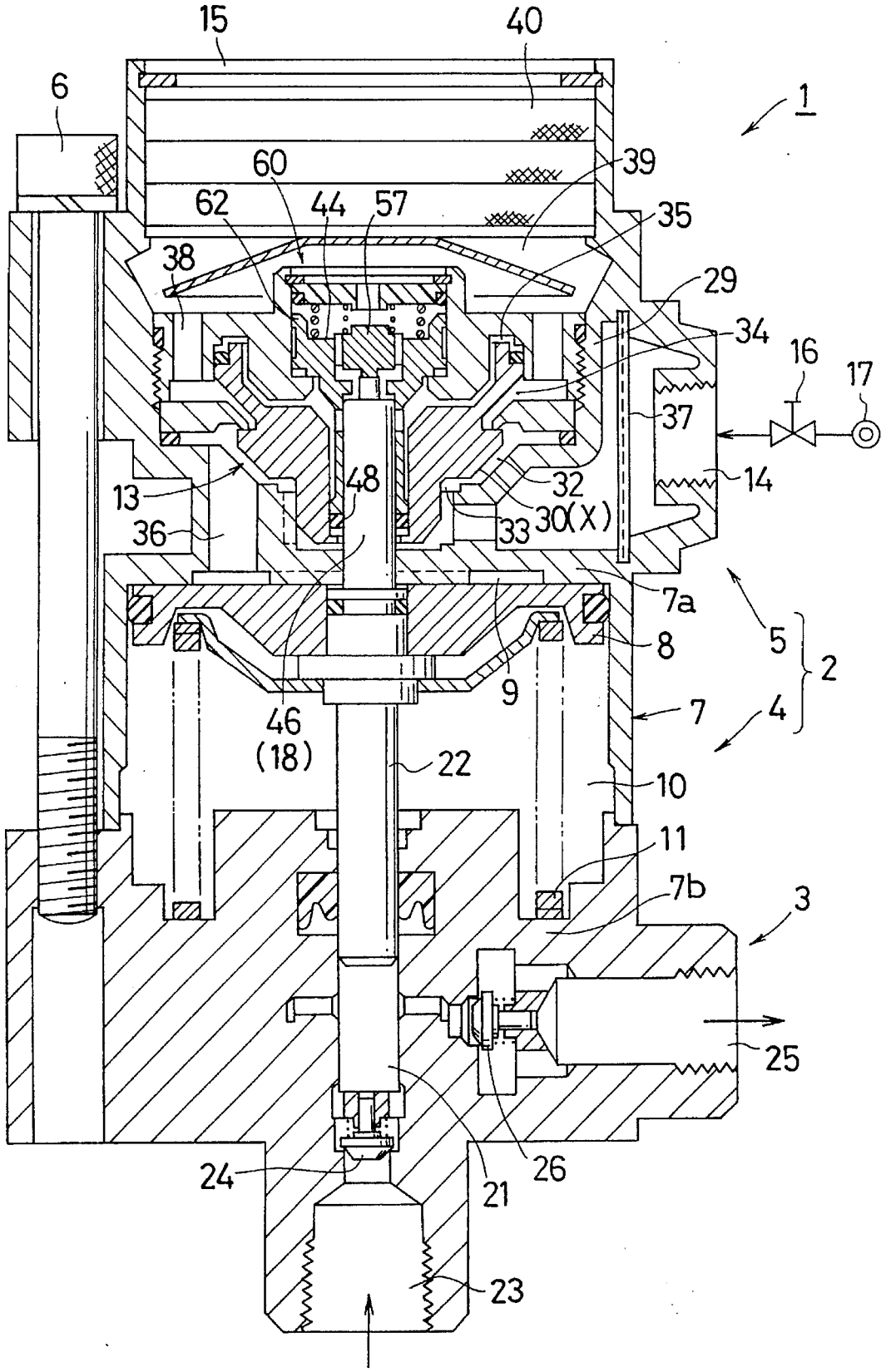
Figure 3:
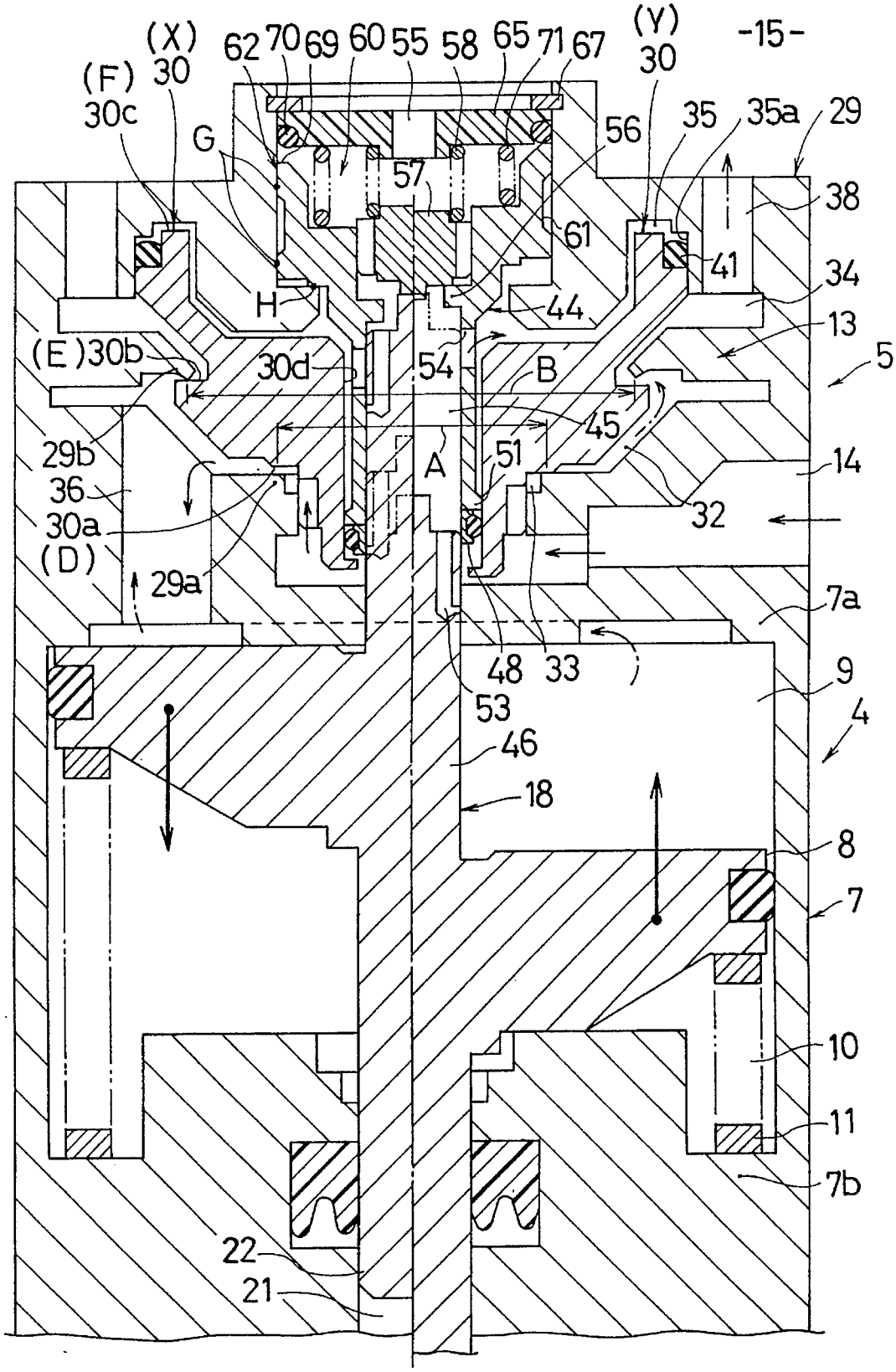

One embodiment of the present invention will be explained with reference to the accompanying drawings hereinafter. FIGS. 1 through 3 example a driving apparatus of the present invention applied to a booster pump apparatus.

FIG. 1 is an enlarged detailed view of FIG. 2. FIG. 2 is a vertical sectional view of the booster pump apparatus. FIG. 3 is a view for explaining an operation of the driving apparatus.

Figure 5:
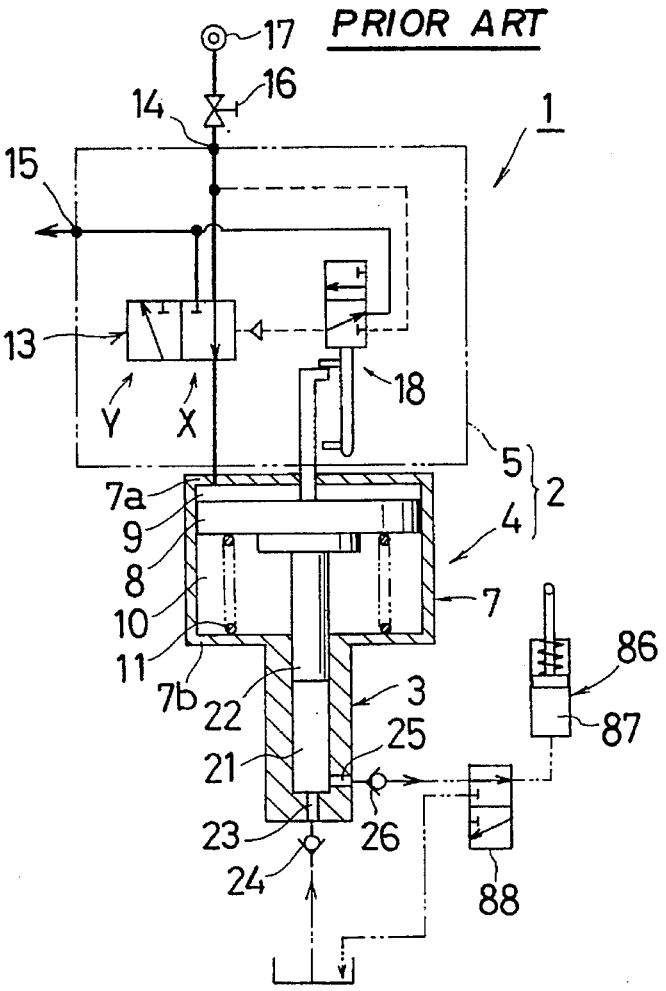
FIG. 5 PRIOR ART
FIG. 5 is a system view showing a basic constitution as a premise of the present invention.
Figure 6:
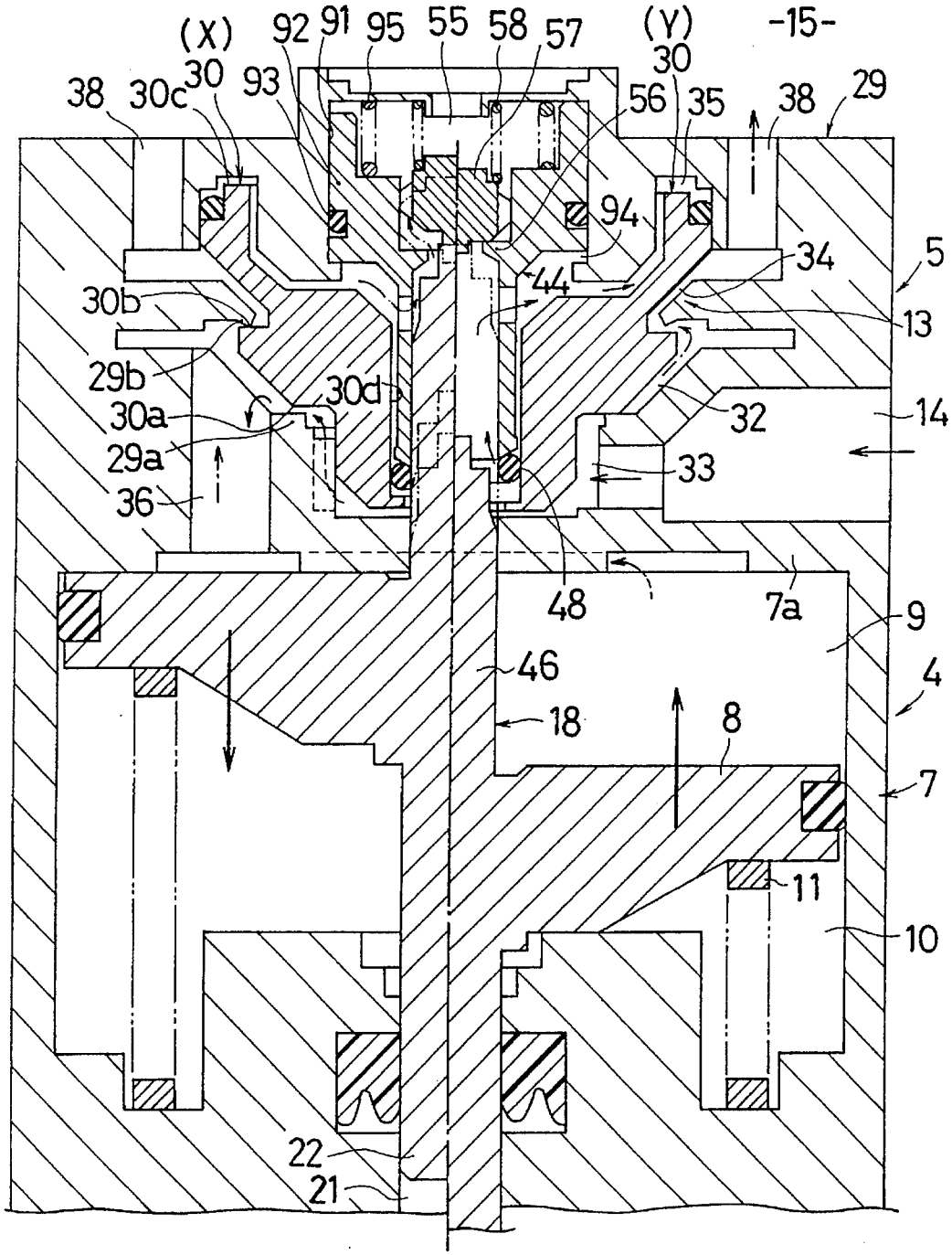
PRIOR ART FIG. 6
FIG. 6 shows a conventional example and is a view corresponding to FIG. 3.

Incidentally, in this embodiment, component members having the same constitutions as those of the aforementioned conventional example (refer to FIGS. 5 and 6) are, in principle, designated with the same symbols.

As shown in FIG. 2, the booster pump apparatus 1 comprises an apparatus 2 for driving a piston by air pressure (fluid pressure) adapted to generate reciprocating linear movement by making use of the compressed air and a hydraulic pump 3 of the plunger type adapted to deliver a high-pressure oil when being driven by the driving apparatus 2.

The driving apparatus 2 comprises a driving apparatus main body 4 adapted to convert pressure energy of pressurized air into power and supply-discharge means 5 for supplying and discharging the compressed air to and from the driving apparatus main body 4. These main body 4 and supply-discharge means 5 are tightly connected to the hydraulic pump 3 by a plurality of tie rods 6 (herein, only one rod is illustrated).

The driving apparatus main body 4 is of the single-acting spring-returned type.

That is, the piston 8 is inserted airtightly into the cylinder 7 so as to be vertically slidable. The driving chamber 9 is formed between the upper wall 7*a* of the cylinder 7 and the piston 8, a spring chamber 10 is formed between the lower wall 7*b* of the cylinder 7 and the hot tom of the piston 8, and a return spring 11 is installed in the spring chamber 10. When the compressed air is supplied to the driving chamber 9, the piston 8 is driven toward the bottom dead center against a resilient force of the return spring 11. When the compressed air is discharged from the driving chamber 9, the piston 8 is returned toward the top dead center by the resilient force of the return spring 11.

The driving chamber 9 is so switched by the supply-discharge valve 13 of the supply-discharge means 5 as to be selectively communicated with the pressure supply port 14 and the pressure discharge port 15. The supply port 14 is communicated with the air pressure source (fluid pressure source) 17 through the pressure fluid supply valve 16, and the discharge port 15 is opened to the atmosphere side. The supply-discharge valve 13 can be switched by the pilot valve 18 between the supply position X on the upper side and the discharge position Y on the lower side (refer to FIG. 3).

The hydraulic pump 3 has the plunger 22 inserted into the pump chamber 21 so as to be vertically slidable in an oil-tight manner. When the plunger 22 is descended by the piston 8, a delivery valve member 26 is opened so that the working oil within the pump chamber 21 is delivered from a delivery port 25. To the contrary, when the plunger 22 is ascended by the piston 8, a suction valve 24 is opened so that the working oil is sucked into the pump chamber 21 through a suction port 23. By repeating those strokes, the high-pressure working oil can be delivered.

Next, a constitution of the fluid supply-discharge means 5 will be explained mainly by FIG. 3 with reference to FIGS. 1 and 2. The left half view of FIG. 3 shows an initial state of the descending drive stroke of the piston 8, and the right half view thereof shows an initial state of the ascending return stroke of the piston 8.

The supply-discharge valve 13 is provided with the supply-discharge valve casing 29 disposed above the cylinder 7 and the supply-discharge valve member 30 vertically movably inserted into the supply-discharge valve casing 29. The supply-discharge valve member 30 is switched to the supply position X of the left half view when being pushed upward and switched to the discharge position Y of the right half view when being pushed downward.

The supply actuation chamber 33 is formed below the supply-discharge valve member 30, the working chamber 32 is formed around the lower outer peripheral portion of the supply-discharge valve member 30 as well as the discharge chamber 34 is formed around the upper outer peripheral portion thereof, and the discharge actuation chamber 35 is formed above the supply-discharge valve member 30.

The working chamber 32 is communicated with the driving chamber 9 through a supply-discharge port 36. The supply-port 14 is communicated with the discharge port 15 through a filter 37, the supply actuation chamber 33, a bore of a supply-side valve seat 29*a*. the working chamber 32, a bore of a discharge-side valve seat 29*b*. the discharge chamber 34, discharge ports 38 and an outlet chamber 39 in order. A silencer 40 is internally installed to the outlet chamber 39. Further, the discharge actuation chamber 35 and the supply actuation chamber 33 are vertically communicated with each other through the bore 30*d* of the supply-discharge valve member 30. The discharge actuation chamber 35 is separated from the discharge chamber 34 by the O-ring 41 interposed between its outer peripheral surface 35*a* and the outer peripheral surface of the supply-discharge valve member 30.

The supply-discharge valve member 30 is provided with an inner cylindrical portion 42 and an outer cylindrical portion 43 externally airtightly fitted around the inner cylindrical portion 42 (refer to FIG. 1). A pressure receiving surface 30*a* for pressure supply is formed in a lower surface of the outer cylindrical portion 43 so as to face the supply actuation chamber 33, and a discharge-side pressure receiving surface 30*b* is formed in an upper surface of the outer cylindrical portion 43 so as to face the discharge chamber 34. Further, a pressure receiving surface 30*c* for pressure discharge is formed in an upper surface of the inner cylindrical portion 42 so as to face the discharge actuation chamber 35. An outer diameter A of the pressure receiving surface 30*a*, an outer diameter B of the pressure receiving surface 30*b* and an outer diameter of the pressure receiving surface 30*c* are so set as to get larger in this order. Accordingly, a pressure receiving sectional area E of the pressure receiving surface 30*b* becomes larger than a pressure receiving sectional area D of the pressure receiving surface 30*a* and a pressure receiving sectional area F of the pressure receiving surface 30*c* becomes larger than the pressure receiving sectional area E.

As shown in the left half view of FIG. 3, when the supply-discharge valve member 30 is so pushed up as to be switched to the supply position X, the pressure receiving surface 30*a* for pressure supply is separated from the supply-side valve seat 29*a*, so that the supply actuation chamber 33 and the working chamber 32 are communicated with each other and at the same time, the discharge-side pressure receiving surface 30*b* is seated onto the discharge-side valve seat 29*b* to seal between the working chamber 32 and the discharge chamber 34. To the contrary, as shown in the right half view of FIG. 3, when the supply-discharge valve member 30 is so pushed down as to be switched to the discharge position Y, the pressure receiving surface 30*a* is seated onto the supply-side valve seat 29*a* to seal between the supply actuation chamber 33 and the working chamber 32 as well as the pressure receiving surface 30*b* is separated from the discharge-side valve seat 29*b* so that the working chamber 32 and discharge chamber 34 are communicated with each other.

The pilot valve 18 is so constituted as to switch the fluid pressure supply-discharge valve 13 to the supply position X and the discharge position Y.

That is, the sleeve 44 is inserted vertically movably into the bore 30*d* of the supply-discharge valve member 30. The spool valve member 46 is inserted vertically movably into a pilot valve chamber 45 of the sleeve 44, and the spool valve member 46 is formed integrally with the piston 8.

The annular sealing member 48 is interposed between the supply port 14 and the discharge actuation chamber 35. The annular sealing member 48 is fitted airtightly between the outer peripheral surface of the spool valve member 46 and the bore 30*d* and comprises a tubular saddle member 49 externally fitted around the outer peripheral surface of the spool valve member 46 and an O-ring 50 externally fitted around the outer peripheral surface of the tubular saddle member 49. The tubular saddle member 49 is formed of such a material, for example ultrahigh-molecular weight polyethylene and so on, as to be excellent in wear-resisting property and self-lubricating effect. The O-ring is formed of such a material, for example nitrile rubber and so on, as to be excellent in sealing property. Upward moving of the annular sealing member 48 is prevented by a receiving portion 51 formed in a lower portion of the sleeve 44.

Six pressure supply passages 53 for communicating the supply port 14 with the pilot valve chamber 45 are arranged peripherally in the upper portion of the spool valve member 46 (herein, only two of them are illustrated). Upper ends of the supply passages 53 are opened in an upper surface of the spool valve member 46, and lower ends of the supply passages 53 are opened in the outer peripheral surface of the spool valve member 46. Thereby, at an end stage of the descending movement of the spool valve member 46, the supply port 14 can be communicated with the discharge actuation chamber 35 through the supply passages 53, the pilot valve chamber 45 and a through-hole 54 of the sleeve 44.

The pressure relief port 55 communicated with the pressure discharge port 15 is formed in an upper portion of the supply-discharge valve casing 29, and a pressure relief valve seat 56 and a pressure relief valve member 57 are arranged within the upper portion of the sleeve 44. The relief valve member 57 is resiliently urged onto the relief valve seat 56 by a valve closing spring 58.

Further, between the discharge actuation chamber 35 and the pressure relief port 55 there are provided an opening-closing means 60 and a restriction passage G arranged in tandem relative to an opening-closing portion of the opening-closing means 60. The opening-closing means 60 is held in an opened state when the pressure of the discharge actuation chamber 35 is lower than the predetermined pressure, and the opened state is cancelled when the pressure of the discharge actuation chamber 35 becomes at least the predetermined pressure.

That is, a valve bore 61 for communicating the discharge actuation chamber 35 with the pressure discharge port 15 is formed in the upper portion of the supply-discharge valve casing 29 so as to be substantially coaxial with the bore 30*d*. A cylindrical opening-closing valve member 62 is inserted vertically slidably into the valve bore 61, and the opening-closing valve member 62 is fixedly secured to the upper portion of the sleeve 44.

An inlet chamber 64 is arranged between a lower end wall 63 as one end wall of the valve bore 61 and the opening-closing valve member 62, and an outlet chamber 66 is arranged between an upper end wall 65 as the other end wall of the valve bore 61 and the opening-closing valve member 62. The upper end wall 65 is made of plastic and received by the supply-discharge valve casing 29 through a stop ring 67.

The restriction passage G is so constituted as to communicate with the inlet chamber 64 and the outlet chamber 66, and more concretely, it is constituted by a fitting clearance between the outer peripheral surface of the opening-closing valve member 62 and the inner peripheral surface of the valve bore 61. A closing valve surface 69 is formed in an upper surface of the opening-closing valve member 62, and a valve seat 70 made of an O-ring is arranged in a lower outer peripheral portion of the upper end wall 65. The opening-closing portion is constituted by these valve surface 69 and the valve seat 70. Between the upper end wall 65 and the opening-closing valve member 62 there is interposed a valve opening spring 71 as a resilient member. The opening-closing valve member 62 is pushed downward by the valve opening spring 71 so as to be separated from the valve seat 70.

Incidentally, a contact clearance it is formed between the lower surface of the opening-closing valve member 62 and the lower end wall 63. The opening*closing valve member 62 can be made to slide rightly by grease put into a groove 72 formed in its peripheral surface. The valve opening spring 58 is mounted between the pressure relief valve member 57 and the upper end wall 65.

As shown mainly in FIG. 1, the pilot valve 18 and the opening-closing means 60 operate as follows.

When the spool valve member 46 is switched over from the top dead center state indicated by the solid line in the left half view of FIG. 3 to the bottom dead center state indicated by the alternate long and two short dashes line in the left half view thereof accompanying with the descending of the piston 8, firstly the pressure relief valve member 57 is seated on the pressure relief valve seat 56 and then the lower end of the pressure supply passage 53 of the spool valve member 46 starts to be separated downward from the lower surface of the annular sealing member 48 as indicated by the alternate long and short dash line in the left half view thereof (or the alternate long and short dash line in FIG. 1).

Thereupon, the compressed air of the pressure supply port 14 starts to be supplied to the discharge actuation chamber 35 through the pressure supply passage 53, the pilot valve chamber 45 and the through-hole 54 of the sleeve 44 as well as starts to be supplied from the discharge actuation chamber 35 to the inlet chamber 64 through the contact clearance H. The compressed air supplied to the inlet chamber 64 is discharged to the pressure discharge port 15 through a space between the closing valve surface 69 and the valve seat 70 after having passed through the restriction passage G.

When the spool valve member 46 is further descended so that the lower end opening of the pressure supply passage 53 faces the pressure supply port 14, the compressed air of the supply port 14 is supplied abundantly to the discharge actuation chamber 35. Thereby, since a flowing amount of the air passing through the restriction passage increases and also flowing resistance thereof increases, the pressure of the inlet chamber 64 increases. Thereupon, as indicated by the solid line in the right half view of FIG. 3, firstly the opening-closing valve member 62 and the sleeve 44 are ascended against the two springs 58, 71 and the closing valve surface 69 are brought into closing contact with the valve seat 70, so that the discharging of the compressed air is prevented. Thus, the pressure within the discharge actuation chamber 35 is quickly increased and the supply-discharge valve member 30 is pushed down strongly by the increased pressure, so that the valve member 30 is switched to the discharge position Y of the right half view thereof. Thereby, the driving apparatus 9 is communicated with the discharge port 15 through the supply-discharge port 36, the working chamber 32, the discharge chamber 34 and the discharge ports 38, so that the ascending return stroke of the piston 8 is started.

Incidentally, while the supply-discharge valve member 30 is pushed down, a back pressure resistance decreases from the force imposed to the pressure receiving sectional area E of the discharge-side pressure receiving surface **30*b* to the force imposed to the pressure receiving sectional area D of the pressure receiving area 30*a* for pressure supply during its descending. Therefore, a descending speed of the supply-discharge valve member 30** increases on a midway of its descending, so that the switching to the discharge position Y can be carried out more reliably.

Then, when the spool valve member 46 is switched over from the bottom dead center position indicated by the solid line in the right half view of FIG. 3 to the top dead center position indicated by the alternate long and two short dashes line in the right half view thereof accompanying with the ascending of the piston 8, firstly the outer peripheral surface of the pool valve member 46 is brought into sealing contact with the inner peripheral surface of the saddle member 49, then the pressure relief valve member 57 is separated from the pressure relief valve seat 56 against the valve closing spring 58, so that the discharge actuation chamber 35 is communicated with the discharge port 15 through the through-hole 54 of the sleeve 44, the pressure relief valve seat 56 and the pressure relief port 55. Thereby, the supply-discharge valve member 30 is pushed up by a vertical differential pressure to be switched to the supply position X of the left half view. Thereupon, the driving chamber 9 is communicated with the supply port 14 through the supply-discharge port 36, the working chamber 32 and the supply actuation chamber 33, so that the descending drive stroke of the piston 8 is started.

According to the above-mentioned embodiment, the following advantages can be obtained.

When an amount of the compressed air supplied to the discharge actuation chamber 35 is extremely a little, owing to the functions of the restriction passage G and the opening-closing means 60, the pressure increasing of the discharge actuation chamber 35 can be prevented and the pressure of the actuation chamber 35 can be quickly increased when the supplied amount of the compressed air has been increased. Therefore, the supply-discharge valve member 30 is pushed strongly from the supply position X to the discharge position Y, so that the stopping of the supply-discharge valve member 30 during its switching can be prevented.

Since the restriction passage G is arranged between the chamber 64 and the outlet chamber 66 and the opening-closing valve member 62 is moved for valve closing by the differential pressure between both these chambers 64, 66, the constitution is simple and the operation is reliable.

Since the restriction passage G is constituted by the fitting clearance between the valve bore 61 and the opening-closing valve member 62, the manufacturing cost is low and both the surface roughness and the flow sectional area of the restriction passage G can be finished with high accuracy. Therefore, it becomes easy to set the flowing resistance of the restriction passage G to a desired value, and the operational accuracy the opening-closing means 60 can be enhanced.

Since the valve bore 61 of the opening-closing means 60 and the bore **30*d* of the supply-discharge valve member 30 are arranged coaxially and the opening-closing valve member 62 is fixedly secured to the upper portion of the sleeve 44 inserted into the bore 30*d***, the number of component members becomes decreased and the constitution becomes simpler.

Since the pressure supply passage 53 is formed in the upper portion of the spool valve member 46, it becomes unnecessary to form the tapered portion of the conventional example in the outer peripheral surface of the valve member 46. Further, since the tubular saddle member 49 having the good wear-resistive property is externally fitted around the outer peripheral surface of the valve member 46, the durability of the annular sealing member 48 can be enhanced. Incidentally, according to the experimental results, the durability time is about 200 hrs. in the case of the annular sealing member 48 constituted by only the O-ring and it can be extended over 2000 hrs. ten times as long as that in the case of the constitution of the present invention so that the durability can be improved greatly.

Figure 4:
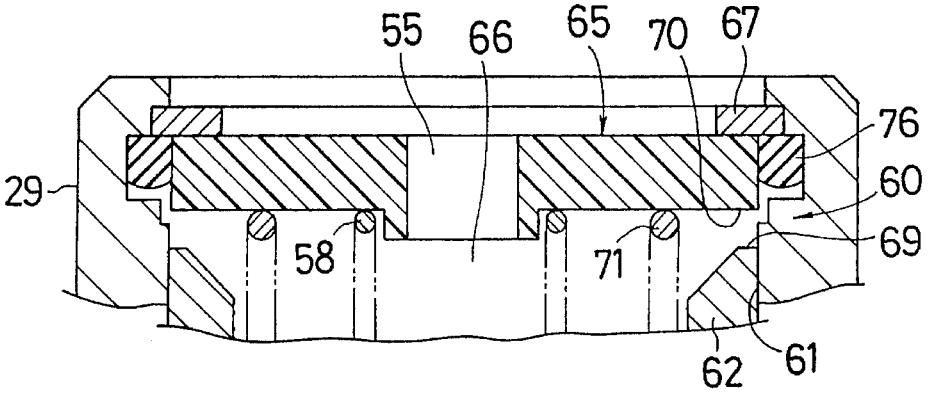

FIG. 4 shows a variant example of the opening-closing means. In this variant example, component members having the same constitutions as those in the above embodiment are, in principle, designated by the same symbols.

As a constitution of this variant example different from the above embodiment, the valve seat 70 of the opening-closing means 60 is constituted by the lower surface of the upper end wall 65 made of the plastic.

Incidentally, a space between the outer peripheral surface of the upper end wall 65 and the supply-discharge valve casing 29 is sealed by an O-ring 76.

The upper end wall 65 may be constituted by a metal plate having a lower surface applied with plastic coating instead of the whole plastic constitution.

Each of above mentioned embodiment and variant examples may be changed as follows.

The opening-closing valve member 62 of the opening-closing means 60 may be arranged as a separate member relative to the sleeve 44 of the pilot valve 18. In this case, the sleeve 44 may be fixedly secured to the supply-discharge valve casing 29 and the valve bore 61 of the opening-closing means 60 may be formed separately in another portion of the supply-discharge valve casing 29.

The resilient member for opening the opening-closing valve member 62 may be constituted by rubber and so on instead of the spring 71.

The restriction passage G may be constituted by a restriction port formed as a through-hole between the opposed end walls of the opening-closing valve member 62 instead of the fitting clearance. In this case, it is preferable to arrange a needle valve at the restriction port.

Further, the restriction passage G is not limited to one passage because it is enough that the passage serves to impose flow resistance to the fluid at the time of passing therethrough. For example, the restriction passage G may be constituted by a multiplicity of pores of a filter formed by stacking up fine meshes.

Further, the opening-closing means 60 may comprise a valve seat port for communicating the discharge actuation chamber 35 with the atmosphere side, a pressure sensor for detecting the pressure of the discharge actuation chamber 35 and a valve member adapted to close the valve seat port based on a detection signal of the pressure sensor instead of the one adapted to move the opening-closing valve member 62 by the differential pressure between the opposed end surfaces thereof. In this case, the restriction passage G may be disposed on a downstream side of the valve seat port.

The annular sealing member 48 of the pilot valve 18 may be mounted to the inner peripheral surface of the receiving portion 51 instead that it is mounted to the lower surface of the receiving portion 51 of the sleeve 44. The sealing member 48 may be constituted by only the O-ring 50 with the saddle member 49 omitted. Further, instead of the O-ring 50, other kinds of packings may be employed.

The present invention may have the restriction passage G and the opening-closing means 60 mounted to the discharge actuation chamber 35 and, of course may be applied to variant examples of the constitutions for switching the supply-discharge valve 13 and the pilot valve 18.

Incidentally, the booster pump apparatus 1 may be used in such a manner as a vertically inverted arrangement, a lateral arrangement, or an inclined arrangement. The driving apparatus 2 may operate with other kinds of gasses such as nitrogen or with a liquid such as a pressurized oil.

Further, a driven apparatus to be driven by the above-mentioned driving apparatus 2 may be a pneumatic pump instead of the hydraulic pump 3. In the case of this pneumatic pump, since the piston 8 can be ascended and returned by the air pressure introduced into the pump chamber 21, the return spring 11 may be omitted. Further, it is enough to employ such an apparatus as to convert the reciprocating linear movement to a mechanical work or other kinds of apparatus as the driven apparatus.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be considered as being included therein.

What is claimed is:

1. An apparatus for driving a piston by fluid pressure, comprising:

a fluid pressure supply-discharge valve (13) having a supply-discharge valve casing (29) and supplying and discharging a pressure fluid to and from a driving chamber (9) facing a piston (8);

a supply-discharge valve member (30) so accommodated within the supply-discharge valve casing (29) as to be switchably movable between a supply position (X) and a discharge position (Y);

the supply actuation chamber (33) for switching the supply-discharge valve member (30) to the supply position (X) by the pressure fluid supplied to the supply actuation chamber (33);

a dischagre actuation chamber (35) for switching the supply-discharge valve member (30) to the discharge position (Y) by the pressure fluid supplied to the discharge actuation chamber (35);

a pilot valve (18) for supplying and discharging the pressure fluid to and from the discharge actuation chamber (35);

an opening-closing means (60) having an opening-closing portion (69, 70) and being interposed between the discharge actuation chamber (35) and an outside space of the supply-discharge valve casing (29), the opening-closing means (60) being held in an opened state when the pressure within the discharge actuation chamber (35) being lower than a predetermined pressure, and the opened state of the opening-closing means (60) being cancelled when the pressure within the discharge actuation chamber (35) becoming at least the predetermined pressure; and a restriction passage (G) arranged in series relative to the opening and closing portion (69, 70).

2. An apparatus for driving a piston by fluid pressure as set forth in claim 1, wherein the opening-closing means (60)

comprises a valve bore (61) communicating with the discharge actuation chamber (35), an opening-closing valve member (62) so inserted into the valve bore (61) as to be reciprocatingly movable, an inlet chamber (64) formed between one end wall (63) of the valve bore (61) and the opening-closing valve member (62), an outlet chamber (66) formed between the other end wall (65) of the valve bore (61) and the opening-closing valve member (62), the opening-closing portion (69, 70) comprising a valve seat (70) formed in a wall surface of the outlet chamber (66) and a closing valve surface (69) formed in the opening-closing valve member (62) and a resilient member (71) for separating the valve surface (69) from the valve seat (70), and the outlet chamber (66) and the inlet chamber (64) are communicated with each other by the restriction passage (G).

3. An apparatus for driving a piston by fluid pressure as set forth in claim 2, wherein the restriction passage (G) is constituted by a fitting clearance between the inner peripheral surface of the valve bore (61) and an outer peripheral surface of the opening-closing valve member (62), and the valve seat (70) is disposed in the other end wall (65) of the valve bore (61).

4. An apparatus for driving a piston by fluid pressure including a driving chamber (9) disposed above a piston (8) inserted into a cylinder (7), a fluid pressure supply-discharge valve (13) for switchably communicating the driving chamber (9) with a pressure supply port (14) and with a pressure discharge port (15) and a pilot valve (18) for switching the supply-discharge valve (13) between a supply position (X) and a discharge position (Y), the supply-discharge valve (13) comprising a cylindrical supply-discharge valve casing (29) disposed above the cylinder (7) and a supply-discharge valve member (30) vertically slidably inserted into the supply-discharge valve casing (29), a supply actuation chamber (33) to be communicated with the pressure supply port (14) being disposed below the supply-discharge valve member (30), and a discharge actuation chamber (35) to be selectively communicated with the pressure supply port (14) and the pressure discharge port (15) being disposed above the supply-discharge valve member (30), the pilot valve (18) comprising a sleeve (44) inserted into a bore (30*d*) of the supply-discharge valve member (30), a spool valve member (46) vertically movably inserted into the sleeve (44), an annular sealing member (48) interposed between the pressure supply port (14) and the discharge actuation chamber (35), and a pressure relief valve member (57) interposed between the discharge actuation chamber (35) and the pressure discharge port (15), the annular sealing member (48) being fitted between an outer peripheral surface of the spool valve member (46) and the bore (30*d*), a receiving portion (51) adapted to be brought in to contact with the annular sealing member (48) from above being formed in a lower portion of the sleeve (44), and the spool valve member (46) being connected to the piston (8), characterized in that the discharge actuation chamber (35) is communicated with a space outside the supply-discharge valve casing (29) through a restriction passage (G) and an opening-closing portion (69, 70) of an opening-closing means (60) in order, that the opening-closing means (60) comprises a valve bore (61) communicated with the discharge actuation chamber (35), an opening-closing valve member (62) vertically slidably inserted into the valve bore (61), the opening-closing portion (69. 70) comprising a closing valve surface (69) formed in an upper portion of the opening-closing valve member (62) and a valve seat (70) formed in an upper end wall (65) of the valve bore (61), a valve opening spring (71) for separating the opening-closing valve member (62) from the valve seat (70), and that the restriction passage (G) is constituted by a fitting clearance between an inner peripheral surface of the valve bore (61) and an outer peripheral surface of the opening-closing valve member (62).

5. An apparatus for driving a piston by fluid pressure as set forth in claim 4, wherein the valve bore (61) is formed substantially coaxially to the bore (30*d*) of the supply-discharge valve member (30), the sleeve (44) is inserted vertically movably into the bore (30*d*), the opening-closing valve member (62) is fixedly secured to an upper portion of the sleeve (44), and the pressure relief valve member (57) is disposed within an upper portion of the sleeve (44).

6. An apparatus for driving a piston by fluid pressure as set forth in claim 4 or claim 5, wherein a pressure supply passage (53) for communicating the pressure supply port (14) with the discharge actuation chamber (35) is formed in an upper portion of the spool valve member (46), an upper end of the pressure supply passage (53) is opened in the upper surface of the spool valve member (46), and a lower end of the pressure supply passage (53) is opened in an outer peripheral surface of the spool valve member (46), and the annular sealing member (48) comprises a tubular saddle member (49) externally fitted around the outer peripheral surface of the spool valve member (46) and an O-ring (50) externally fitted around an outer peripheral surface of the tubular sadlle member (49).

* * * * *